US005255829A

United States Patent [19]

Trumstedt et al.

[11] Patent Number: 5,255,829

[45] Date of Patent: Oct. 26, 1993

[54] DISPENSER FOR DISCHARGING PULVEROUS MATERIAL

[76] Inventors: Per T. Trumstedt; Per N.C. Trumstedt, both of Dyarnevägen 5, S-198 00 Balsta, Sweden

[21] Appl. No.: 862,554

[22] PCT Filed: Dec. 28, 1990

[86] PCT No.: PCT/SE90/00883

§ 371 Date: Jun. 18, 1992

§ 102(e) Date: Jun. 18, 1992

[87] PCT Pub. No.: WO91/09790

PCT Pub. Date: Jul. 11, 1991

[30] Foreign Application Priority Data

Jan. 5, 1990 [SE] Sweden ..... 9000038

[51] Int. Cl.[5] ..... G01F 11/10

[52] U.S. Cl. ..... 222/367; 222/153; 222/363

[58] Field of Search ..... 222/153, 363, 367, 454, 222/456

[56] References Cited

U.S. PATENT DOCUMENTS 2,411,220 11/1946 McDargh, Jr. ..... 222/363
3,241,728 3/1966 Murphy ..... 222/363 X
3,484,025 12/1969 Capalia ..... 222/456
4,058,240 11/1977 Becker .
4,613,064 9/1986 Meyer et al. ..... 222/456
5,169,036 12/1992 Tong ..... 222/363 X

FOREIGN PATENT DOCUMENTS 3004292 8/1981 Fed. Rep. of Germany ..... 222/363
3400660 7/1985 Fed. Rep. of Germany .
2121888 8/1972 France .
34484 5/1984 Sweden .
614173 11/1979 Switzerland .

*Primary Examiner*—Gregory L. Huson
*Attorney, Agent, or Firm*—Frishauf, Holtz, Goodman & Woodward

[57] ABSTRACT

A dispenser for discharging finely-divided or liquid material from a tight or substantially tight package (3) includes an apparatus (1) rotatably disposed in relation to the package (3) by means of a knob (10, 10') and provided with dosage compartments (2*a*, 2*b*, 2*c*, etc.) disposed therein. The dosage compartments are, on rotation of the apparatus (1) by means of the know (10, 10'), arranged to be filled by the material and to be emptied of the material by force of gravity. The apparatus (1) is disposed in an opening (4) in the package (3) so as to block the opening (4). The knob (10, 10') is arranged to be manipulated to rotate the apparatus (1) form an inoperative position to an operative position.

8 Claims, 1 Drawing Sheet

Fig. 1
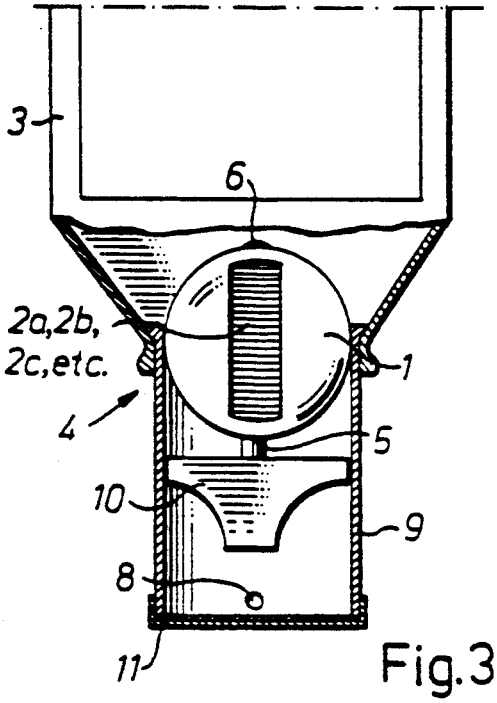
Fig. 2
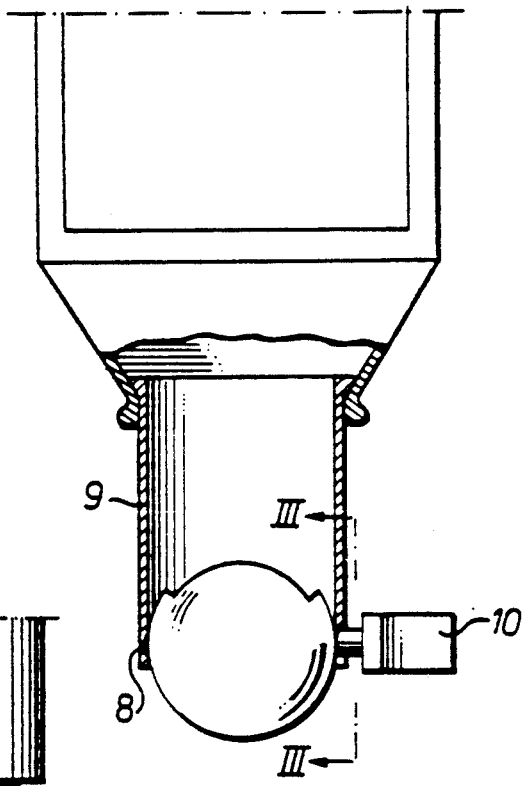
Fig. 3
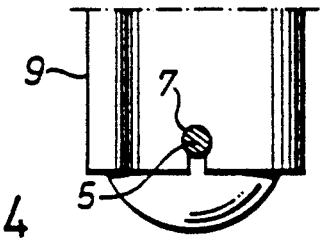
Fig. 4
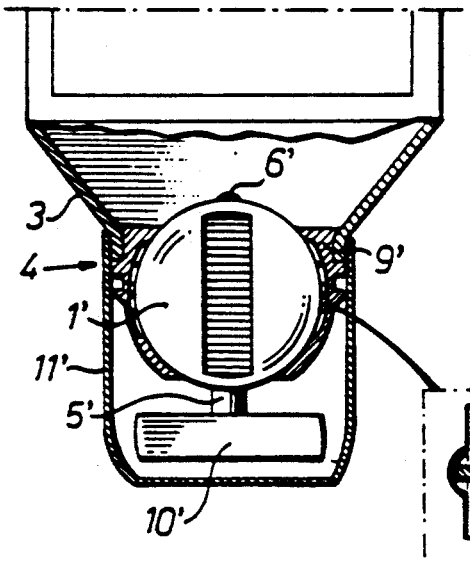
Fig. 5
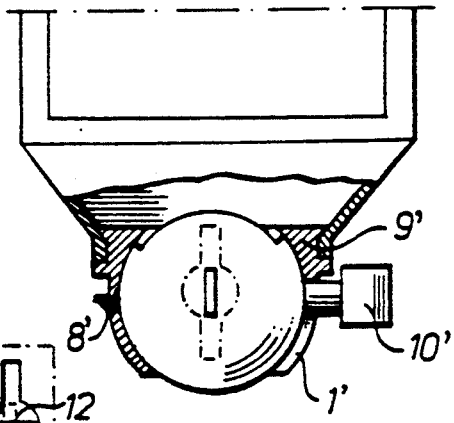
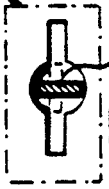
Fig. 6

DISPENSER FOR DISCHARGING PULVEROUS MATERIAL

BACKGROUND OF THE INVENTION

The present invention relates to a dispenser for discharging fluent, finely-divided or liquid material from a tight or substantially tight package Portioning dispensers connected to packages are previously known in a number of different designs. One example of such a prior art dispenser is disclosed in Swedish Registered Design No. 34 484.

In many types of material, both pulverous and liquid, it is vital that no foreign matter penetrates the package to contaminate the material. For this reason, use is made of, for instance, glass jars with diffusion-tight connected lids for the storage of ground coffee in order that the oxygen of the air does not oxidize and thereby mar the flavor of the coffee before the package proper is broken. Hence, packages may be rendered quite diffusion tight, for example by making them of glass, aluminum foil or some other diffusion-tight material.

The weak link in dosage-dispensing packages is the dispenser itself, since this may, by diffusion, let in ambient gases and/or liquids, either directly through the material from which the dispenser is manufactured, or through those apertures, slots, gaps, etc. which are present in the dispenser.

A package containing material of the type contemplated here is normally kept and stored for a relatively lengthy period of time before the package is opened, the material contained therein subsequently being consumed during a relatively short time.

Consequently, considerable progress would be made—in relation to the prior art—if a package with a dispenser and with material in the package were, during storage and transport to the consumer, to be diffusion-tight and, in particular, to be gas diffusion-tight.

Dispensers of the above-described type require some form of device which is accessible exteriorly for operating, for example, a knob to advance compartments with a measured amount of material one at a time to discharge the material from the package. Unintentional operation of the knob by, for example, handling filling, or manual picking however, may run the risk of jeopardizing the diffusion tightness of the package.

SUMMARY OF THE INVENTION

The dispenser of the present invention includes an apparatus which is rotatably disposed in an aperture of the package by means of a knob and which is provided with dosage compartments. On rotation of the apparatus by means of the knob, the compartments are filled by the fluent material and emptied of such material by gravitational force.

According to the present invention, with the aforementioned knob in an inoperative position, the knob not being manipulated to the operative position until it is first to be put into use, unintentional activation of the knob will be prevented, thereby eliminating the risk of accidental contamination of the material within the package.

Such manipulation of the knob may be effected in a plurality of different manners, a number of which are described in greater detail hereinbelow, and others of which will be made obvious by the present disclosure. The nature of the present invention and its aspects will be more readily understood from the following brief description of the accompanying Drawings, and discussion relating thereto.

BRIEF DESCRIPTION OF THE DRAWINGS

FIG. 1 shows a partial cross-section through a dispenser connected to a package in a first embodiment of the invention, with the knob of the dispenser in the inoperative position;

FIG. 2 illustrates the dispenser of FIG. 1 connected to a package in the first embodiment with the knob of the dispenser in the operative position;

FIG. 3 shows the dispenser of FIG. 2 seen in the direction of the arrows III—III;

FIG. 4 shows a second embodiment of the invention in partial cross-section, with the dispenser knob in the inoperative position;

FIG. 5 shows the embodiment according to FIG. 4 but with the cover removed and with the knob in the operative position; and FIG. 6 shows a detail of the embodiment according to FIGS. 4 and 5.

It should be observed that identical reference numerals have been employed in the individual embodiments for identical or substantially identical details.

DESCRIPTION OF THE PREFERRED EMBODIMENTS

According to a simple embodiment of the present invention, which is not illustrated in detail in the drawings, a shaft for the dispenser may be supplied separately and be disposed to be passed through an aperture in the center of a dosing apparatus 1 which is preferably substantially globular in configuration and is provided with portion compartments 2*a*, 2*b*, 2*c*, etc. The shaft becomes, on its insertion, mechanically interconnected with the dosing apparatus. A portion of the shaft is chamfered and at least some part of the aperture of dosing apparatus 1 is given a corresponding configuration so that mechanical interconnection takes place on protrusion of the shaft into this portion. The otherwise rounded shaft is journalled, for instance, in two holes in a bearing box 9', disposed in the opening 4 of a package 3, the shaft being fitted, at its one end, with the above-mentioned knob 10'.

In this simple embodiment, the knob with the shaft may be housed in a cap or case 11' which is made of, for example, a diffusion-tight material, ideally of aluminum which is relatively thin but is of sufficient configurational stability for the loadings which may occur. The cap or casing 11' is, in turn, fixed to the package 3 by means of, for instance, a diffusion-tight tape, the package consisting, by way of example, of glass or some similar, relatively diffusion-tight material.

According to the first illustrated embodiment of the present invention as illustrated in FIGS. 1-3, there is provided, in a package 3 made of substantially diffusion-tight material, for example glass, a dosage apparatus 1 with a knob 10 in an inoperative transport and storage position, the apparatus being disposed within a casing 9 which is provided with a cap 11. By the intermediary of beads, the casing 9 cooperates with and is retained by snap action in the opening 4 of the package 3. It will be apparent from FIG. 1 that the knob 10 and the dosage apparatus 1 are protected from outer action by the casing 9 and by the cap 11, it being moreover presupposed that these latter details are made of diffusion-tight material and are mutually anchored to one another and to the package 3 in a diffusion-tight manner.

After removal of cap 11, the knob 10 is exteriorly accessible and is drawn downwardly a distance, according to FIG. 1, whereafter the knob 10 is turned outwardly from the plane of the drawing to that position which is apparent from FIGS. 2 and 3, the shaft 5 of the knob 10 meshing with a narrow slot 7 with a flared bottom, see in particular FIG. 3, in the casing 9. The opposite, bead-fitted end 6 (see FIG. 1) of the dosage apparatus 1 with the dosage compartments 2*a*, 2*b*, 2*c*, etc. cooperates with a depression 8 in the opposing inner surface of the casing 9. The dosage apparatus 1 with associated dosage compartments 2*a*, 2*b*, 2*c*, etc will be fixed and rotatably located in the correct and contemplated dosage position or operative position in the casing 9 thereby in the opening of the package 3.

On the other hand, according to the second illustrated embodiment as illustrated in FIGS. 4–6, no withdrawal of the dosage apparatus 1' with the knob 10' is required, the manipulation of the apparatus 1' and the knob 10' being instead arranged to take place between the inoperative position and the operative position solely by means of twisting of the knob 10' and thereby of the dosing apparatus 1'. Use is also advantageously made according to this second illustrated embodiment of guide members in the form a slit 7' and a recess 8' in a casing or in a bearing box 9' for guidingly journalling corresponding details, namely the shaft 5' and the bead 6' of the dosing apparatus 1'.

In its inoperative position, the dosing apparatus 1' is covered by a gas diffusion-tight configurationally stable casing or cap 11' which, in turn, is fixed to the package 3 at that part abutting against the package 3 by means of, for example, a gas diffusion-tight tear-off tape (not shown).

The rotary apparatus 1 and 1', respectively are ideally manufactured in substantially spherical form of the same material of which the package 3 itself is manufactured.

In order to prevent unintentional rotation of the rotary apparatus 1' in the inoperative position, one or two walls of the bearing box 9' are—as is apparent from FIGS. 4, 5, and 6—provided with keyhole-like depressions on their inside, the rotary apparatus 1' being provided with projecting beads 12 elongated in one direction (see in particular FIG. 6), these device cooperation to permit rotation of the dosing apparatus 1' once it has been turned to the position illustrated in FIG. 5.

The present invention is not restricted to the particular embodiments described above and shown in the drawings, many modification being conceivable without departing from the spirit and scope of the appended claims.

We claim:

1. A dispenser for discharging fluent material from a substantially tight package, said dispenser comprising:

a rotatable apparatus disposed in an opening in said package and arranged to be rotatable in relation to said package, said rotatable apparatus being provided with dosage compartments disposed therein;

a knob coupled to said rotatable apparatus for rotating said rotatable apparatus relative to said package;

said rotatable apparatus being displaceable relative to said package between a first inoperative position and a second operative position, said rotatable apparatus blocking said opening and thereby preventing discharge of said material from said package in said first inoperative position, and said rotatable apparatus being oriented in said opening so at to be rotatable when in said second operative position such that a position of said rotatable apparatus is controlled by said knob to cause said dosage compartments to communicate the interior of said package with the exterior thereof and be progressively filled with and emptied of fluent by force of gravity.

2. The dispenser as claimed in claim 1, wherein said knob includes means for turning said rotatable apparatus to displace said rotatable apparatus from said first, inoperative position to said second operative position.

3. The dispenser as claimed in claim 1, wherein said knob includes means for pulling and tuning said rotatable apparatus to displace said rotatable apparatus from said first, inoperative position to said second operative position.

4. The dispenser as claimed in claim 3, wherein said knob is pullable in a direction toward the exterior of said package to thereby pull and displace said rotatable apparatus toward said outside of said package.

5. The dispenser as claimed in any one of claim 1–4, further comprising two associated projecting guide means disposed in diametrically opposing portions of said rotatable apparatus and arranged to cooperate with corresponding recesses in a bearing box disposed in said opening of said package, said two associated guide means guiding movement of said rotatable apparatus to said second operative position.

6. The dispenser as claimed in any one of claims 1–4, further comprising a diffusion-tight casing fixed to said package in a diffusion-tight manner, said casing wholly covering both said rotatable apparatus and said knob in said first inoperative position.

7. The dispenser as claimed in any one of claims 1–4, wherein said apparatus substantially comprises a sphere, said compartment disposed therein being directed to from the outer surface of the sphere towards the center thereof.

8. The dispenser as claimed in any one of claims 1–4, wherein said dosage compartments communicate the interior of said package with the exterior thereof so as to empty the fluent material from the interior of the package to the exterior.

* * * * *